US007878173B2

(12) United States Patent
Kishibata

(10) Patent No.: US 7,878,173 B2
(45) Date of Patent: Feb. 1, 2011

(54) CONTROL DEVICE FOR MARINE ENGINE

(75) Inventor: Kazuyoshi Kishibata, Numazu (JP)

(73) Assignee: Kokusan Denki Co., Ltd., Shizuoka-ken (JP)

( * ) Notice: Subject to any disclaimer, the term of this patent is extended or adjusted under 35 U.S.C. 154(b) by 365 days.

(21) Appl. No.: 12/186,176

(22) Filed: Aug. 5, 2008

(65) Prior Publication Data

US 2009/0042459 A1 Feb. 12, 2009

(30) Foreign Application Priority Data

Aug. 6, 2007 (JP) ..... 2007-203801

(51) Int. Cl.
*B63H 21/22* (2006.01)
*F02N 11/00* (2006.01)

(52) U.S. Cl. ..... 123/319; 123/350; 440/1

(58) Field of Classification Search ..... 123/319, 123/350, 352, 355; 440/1, 2, 87, 88 R
See application file for complete search history.

(56) References Cited

U.S. PATENT DOCUMENTS 5,775,311 A * 7/1998 Kato et al. ..... 123/681
6,685,515 B1 * 2/2004 Satoh et al. ..... 440/2
7,179,197 B2 * 2/2007 Asano et al. ..... 477/166

FOREIGN PATENT DOCUMENTS

DE 31 05 331 A * 9/1982
JP H01-224463 A 9/1989
JP H06-213112 8/1994

* cited by examiner

*Primary Examiner*—Hieu T Vo
(74) *Attorney, Agent, or Firm*—Pearne & Gordon LLP

(57) ABSTRACT

A control device for a marine engine comprised so that a section of an angle sufficiently narrower than a crank angle corresponding to each stroke of a combustion cycle of the engine is set as an instantaneous speed detection section, a crank angle position that appears every time the engine rotates in the instantaneous speed detection section is detected as a specific crank angle position, an instantaneous rotational speed of the engine is detected every time each specific crank angle position is detected, it is determined whether the engine needs to be assisted from the degree of reduction in the instantaneous rotational speed, and a motor-generator including a rotor directly connected to a crankshaft of the engine is driven to apply a drive force from the motor-generator to the engine when it is determined that the engine needs to be assisted.

6 Claims, 8 Drawing Sheets

Fig. 5
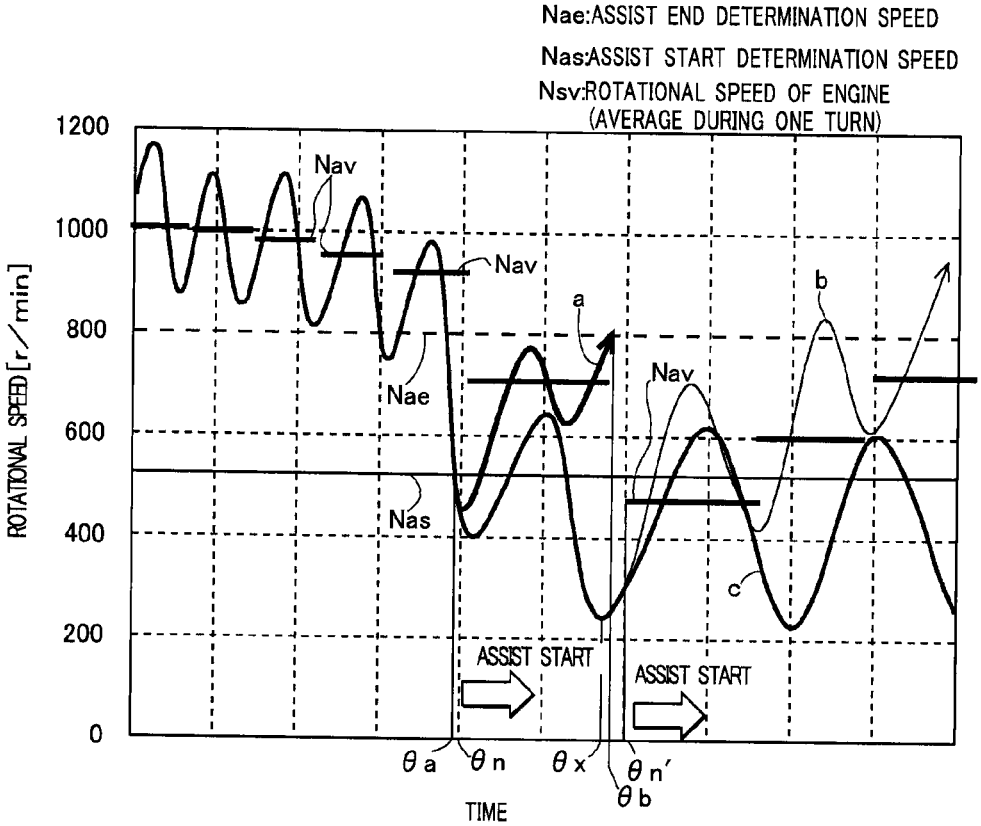
Fig. 6A
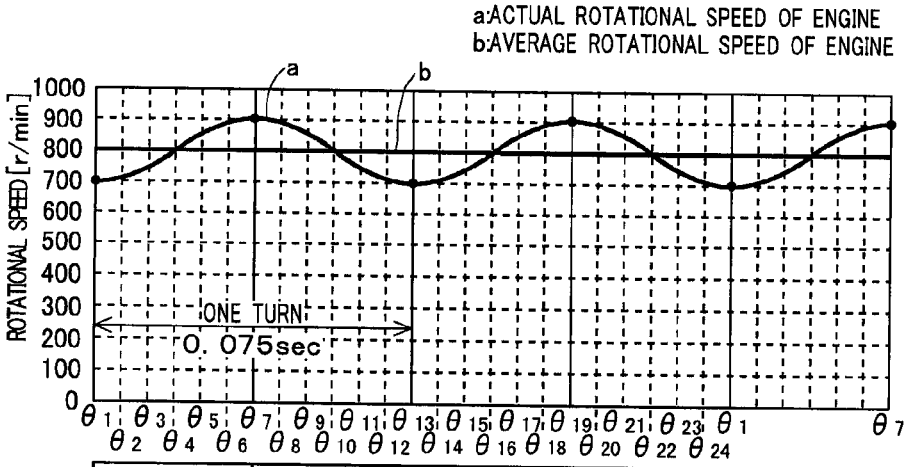
Fig. 6B
Fig. 6C
| | | | | | |
|---|---|---|---|---|---|
| FIRST CYLINDER | EXPANSION | EXHAUST | INTAKE | COMPRESSION | EXPANSION |
| SECOND CYLINDER | INTAKE | COMPRESSION | EXPANSION | EXHAUST | INTAKE |

Fig. 7A
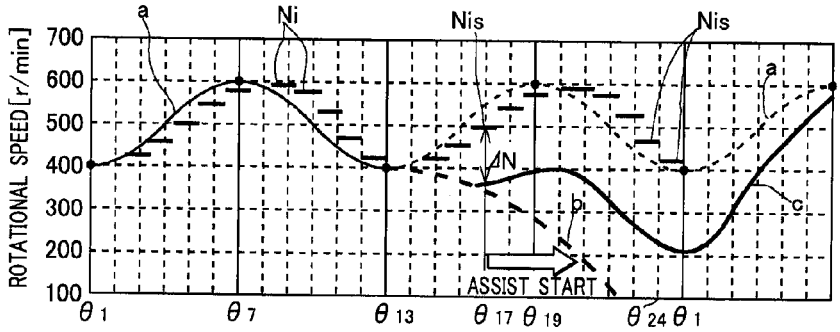
Fig. 7B
Fig. 7C
| | | | | | |
|---|---|---|---|---|---|
| FIRST CYLINDER | EXPANSION | EXHAUST | INTAKE | COMPRESSION | EXPANSION |
| SECOND CYLINDER | INTAKE | COMPRESSION | EXPANSION | EXHAUST | INTAKE |
Fig. 9
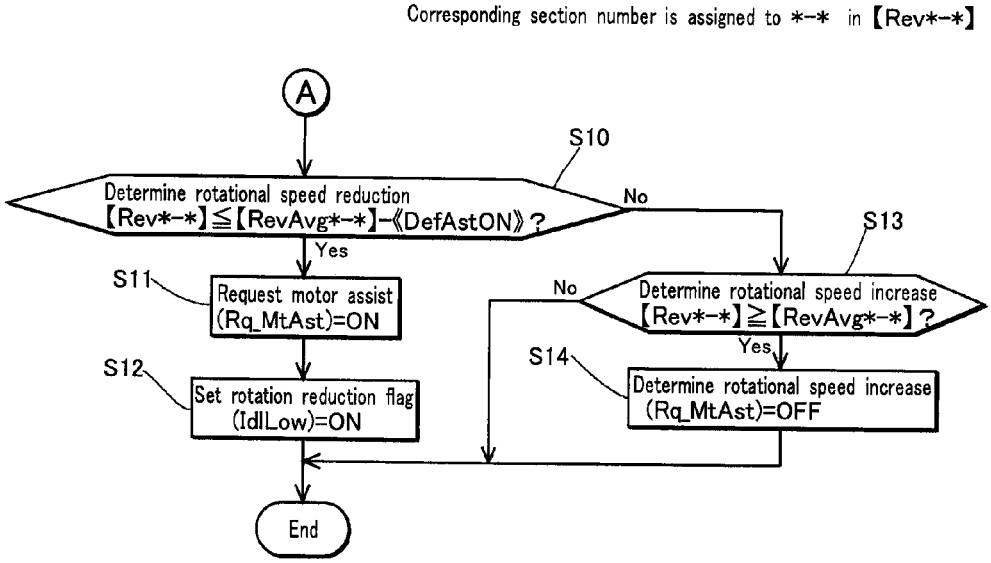

CONTROL DEVICE FOR MARINE ENGINE

TECHNICAL FIELD OF THE INVENTION

The present invention relates to a control device for controlling a marine engine such as an outboard engine.

PRIOR ART OF THE INVENTION

Ships including an outboard engine have no brake. For suddenly stopping a ship during forward navigation in an emergency or in getting to the shore, a shift lever is switched from an "advance" position via a "neutral" position to a "retraction" position to produce thrust in a direction opposite to an advance direction. However, if the shift lever is switched from the advance position to the retraction position to reversely rotate a propeller during advance at a high speed, an excessively large load is applied to an engine, and the engine may stall if output torque during low speed rotation of the engine is low.

To solve the above described problem, in a control device for an outboard engine disclosed in Japanese Patent Application Laid-Open Publication No. 6-213112, a starter motor is driven to assist the engine when it is detected that a shift lever is switched from an advance position to a retraction position and that an average rotational speed of the engine becomes a predetermined value or lower.

As disclosed in Japanese Patent Application Laid-Open Publication No. 1-224463, an engine starting device such as an outboard engine included in a small boat includes: a ring gear mounted to a crankshaft of the engine; a starter motor; a pinion gear connected to a rotating shaft of the starter motor via a clutch mechanism; a push-out mechanism for pushing out the pinion gear toward the ring gear when a rotating shaft of the starter motor rotates; and a retraction mechanism for separating the clutch mechanism to retract the pinion gear away from the ring gear when the engine is started and a rotational speed thereof becomes higher than a rotational speed of the starter motor.

When the engine starting device comprised as described above starts the engine, the pinion gear can successfully mesh with the ring gear in driving the starter motor because the ring gear stops at first. However, if the starter motor is driven while the engine is operated, the pinion gear pushed out toward the ring gear is often flicked by the rotating ring gear, and thus the pinion gear cannot smoothly mesh with the ring gear. This state is the same as a state where a starter motor is accidentally driven after the start of an engine of an automobile, and gears do not mesh with each other with abnormal noises. Using such a starter motor of the starting device is used as a motor for assisting an engine may damage the pinion gear and the ring gear, which inevitably shortens the life of the starting device.

As disclosed in Japanese Patent Application Laid-Open Publication No. 6-213112, in the case where the starter motor is driven to assist the engine when it is detected that the shift lever is switched from the advance position to the retraction position and that the average rotational speed of the engine becomes the predetermined value or lower, detection that the engine enters a state where the engine needs to be assisted may be delayed to delay assisting the engine, which cannot reliably prevent the engine from stalling.

For a small boat, idling is sometimes performed at a low idling speed of an engine to perform so-called trolling in the case where the boat is kept stopped against the tide or turns around at a low speed to stay in a certain water area. Maintaining stable idling is not easy at a low idling speed of the engine without stalling the engine. However, if it is determined that the engine needs to be assisted when the engine is about to stall during idling of the engine, and assist control to assist the engine with a motor is performed, the engine can be operated at a low speed while the low idling speed is maintained, without stalling the engine.

However, when the engine rotates at a low speed, a rotational speed of the engine significantly changes with stroke changes, and if it is determined whether the engine needs to be assisted on the basis of an average rotational speed of the engine, it is difficult to perform accurate assist control to maintain the low speed of the engine. Particularly, for an engine with low output torque during low speed rotation, the engine sometimes cannot be prevented from stalling even if it is determined whether the engine needs to be assisted on the basis of the average rotational speed of the engine to perform the assist control.

SUMMARY OF THE INVENTION

An object of the present invention is to provide a control device for a marine engine that allows accurate control to assist the engine with a motor during normal operation and trolling, and reliably prevent the engine from stalling when a load is suddenly increased during normal navigation and when idling is performed at a low idle setting speed.

Herein, a state where the engine is rotated while an idle setting speed set by narrowing an opening degree of a throttle valve (generally, fully closing the throttle valve) is maintained is referred to as idling, and a state where the engine is rotated at a rotational speed higher than the idle setting speed is referred to as normal operation. For a marine engine, an idle setting speed is not always constant but may be changed by an operator as appropriate.

In the marine engine to which the present invention is applied, in place of a starter motor that has been used, a rotor of a rotating electric machine that can be operated both as an electric motor and a generator is directly connected to a crankshaft of the marine engine, and the rotating electric machine is operated as a starter motor to start the engine.

Such a rotating electric machine is referred to as a motor-generator or a starter-generator, and herein referred to as a motor-generator because the rotating electric machine is operated as a motor for starting the engine and also assisting the engine as required during operation.

The control device for controlling the marine engine according to the present invention includes: crank angle position detection means for detecting each specific crank angle position that appears every time the crankshaft of the engine rotates in an instantaneous speed detection section set to be sufficiently narrower than a crank angle section corresponding to each stroke of a combustion cycle of the engine; instantaneous rotational speed detection means for detecting, as an instantaneous rotational speed of the engine, a rotational speed of the engine detected from a time period between when the last specific crank angle position is detected and when this specific crank angle position is detected, every time the crank angle position detection means detects each specific crank angle position, and storing data including information on the detected instantaneous rotational speed; assist necessity determination means for determining whether a drive force needs to be externally applied to the crankshaft of the engine to assist the engine, from the degree of reduction in the instantaneous rotational speed detected by the instantaneous rotational speed detection means; and motor-generator drive means for driving the motor-generator so as to apply the drive force from the motor-generator to the engine when the assist necessity determination means determines that the engine needs to be assisted.

As described above, the motor-generator including the rotor directly connected to the crankshaft of the engine is driven as the motor to start and assist the engine. Thus, gears do not need to mesh with each other or be disengaged from each other at the start and the end of assisting, thereby preventing the life of the starting device for the marine engine from being shortened.

As described above, the crank angle position detection means is provided for detecting each specific crank angle position that appears every time the crankshaft of the engine rotates in the instantaneous speed detection section set to be sufficiently narrower than the crank angle section corresponding to each stroke of the combustion cycle of the engine, and the rotational speed of the engine is detected from the time period between when the last crank angle detection signal is generated and when this crank angle detection signal is generated, every time the crank angle sensor detects each specific crank angle position, thereby allowing accurate detection of the instantaneous rotational speed of the engine.

It is determined whether the drive force needs to be externally applied to the crankshaft of the engine to assist rotation of the engine, from the degree of reduction in the instantaneous rotational speed thus detected, and the motor-generator is driven so as to apply the drive force from the motor-generator to the engine when it is determined that the engine needs to be assisted. This allows immediate detection that the engine enters a state where the engine needs to be assisted, and allows the engine to be assisted, thereby reliably preventing the engine from stalling when a shift lever is switched from an advance position to a retraction position or when idling is performed at a low idle setting speed to perform trolling.

In a preferred aspect of the present invention, operation state determination means is provided for determining whether the engine is in an idling state or a normal operation state. In this case, the assist necessity determination means is comprised of normal time assist necessity determination means for determining whether the engine needs to be assisted when the operation state determination means determines that the engine is in the normal operation state, and idle time assist necessity determination means for determining whether the engine needs to be assisted when the operation state determination means determines that the engine is in the idling state.

The normal time assist necessity determination means is comprised so as to determine that the engine needs to be assisted when the instantaneous rotational speed detected by the instantaneous rotational speed detection means becomes a normal time assist start speed or lower set to a certain value irrespective of the crank angle position, and maintain the state of determination that the engine needs to be assisted until the instantaneous rotational speed detected by the instantaneous rotational speed detection means becomes an assist end speed or higher set to be higher than the normal time assist start speed once it is determined that the engine needs to be assisted.

The idle time assist necessity determination means is comprised so as to determine that the engine needs to be assisted when the instantaneous rotational speed detected at each specific crank angle position by the instantaneous rotational speed detection means is an idle time assist start speed or lower set to be lower than a stable operating time instantaneous rotational speed during idling at each specific crank angle position, and maintain the state of determination that the engine needs to be assisted until it is detected that the instantaneous rotational speed detected at each specific crank angle position becomes the stable operating time instantaneous rotational speed during idling at the specific crank angle position once it is determined that the engine needs to be assisted.

In idling the engine at the low idle setting speed, the rotational speed minutely changes with stroke changes, and thus it is difficult to accurately determine whether the engine needs to be assisted even if a uniform determination speed to be compared with the instantaneous rotational speed is defined.

In the present invention, as described above, with reference to the stable operating time instantaneous rotational speed (the instantaneous rotational speed during stable rotation of the engine) during idling at each specific crank angle position, it is determined that the engine needs to be assisted when the instantaneous rotational speed detected at each specific crank angle position is the idle time assist start speed or lower set to be lower than the stable operating time instantaneous rotational speed during idling at each specific crank angle position. This allows accurate determination whether the engine needs to be assisted, allows the engine to be assisted when needed, and allows stable idling at a low speed without stalling the engine even when output torque in a low speed rotation area of the engine is low.

The stable operating time instantaneous rotational speed may be previously experimentally examined and stored in a memory in an electronic control unit (ECU) that controls the engine, but a stable operating time instantaneous rotational speed during extremely low speed rotation may change with variations in characteristics of the engine. Thus, in a preferred aspect of the present invention, the idle time assist necessity determination means includes stable operating time instantaneous rotational speed arithmetical operation means for arithmetically operating, as the stable operating time instantaneous rotational speed at each specific crank angle position, an average value of instantaneous rotational speeds detected at each specific crank angle position by the instantaneous rotational speed detection means in a plurality of past combustion cycles during idling of the engine.

As described above, the average value of the instantaneous rotational speeds detected by the instantaneous rotational speed detection means at each specific crank angle position over the plurality of combustion cycles is used as the stable operating time instantaneous rotational speed at each specific crank angle position during idling of the engine. This allows determination whether the engine needs to be assisted with reference to the actual stable operating time instantaneous rotational speed of the engine, thus allows accurate assist control of the engine without being influenced by variations in characteristics of the engine, and prevents the engine from being stopped during idling.

The motor-generator is preferably a rotating electric machine including a magnetic field provided in a rotor, an n-phase (n is an integer equal to or larger than three) armature coil provided in a stator, and n Hall sensors that detect a polarity of a magnetic pole of the rotor on the side of the stator to generate a signal for obtaining information on a rotational angle position of the rotor with respect to the n-phase armature coil of the stator, and comprised so as to operate as a motor when a driving current that is commutated in a predetermined phase order according to output signals of the n Hall sensors is passed through the armature coil. The basic construction of the rotating electric machine is the same as that of a brushless motor.

When the above described rotating electric machine is used, the crank angle position detection means is preferably comprised so as to detect a crank angle position where the signals outputted by the n Hall sensors change their levels as the specific crank angle position.

Generally, as a signal source that generates signals for obtaining rotational position information and crank angle position information of an engine, a pulse signal generator is used comprised of a reluctor (inductor) provided on a rotor that rotates with a crankshaft, and a signal armature (pickup coil) that detects a leading edge and a trailing edge in a rotational direction of the reluctor to generate pulses having different polarities. However, since the pulse signal generator detects changes in magnetic flux with time and induces pulses, it is difficult for the pulse signal generator to generate pulse signals having a level equal to or higher than a threshold when a rotational speed of the engine is extremely low.

On the other hand, a Hall sensor generates a detection signal having a level equal to or higher than a threshold even when a rotational speed of the engine is extremely low. Thus, the Hall sensor is used as a crank angle sensor as described above, thereby allowing reliable detection of the rotational speed information of the engine, and allowing accurate determination whether the engine needs to be assisted even when the rotational speed of the engine is extremely low.

In trolling, a rotational speed of a propeller is preferably adjustable according to the tide or the like. Thus, it is preferable that an idle speed setting device that sets an idle setting speed is provided in an idle control portion that controls the rotational speed of the engine to be maintained at the idle setting speed, and the idle speed setting device is comprised so as to switch the idle setting speed.

BRIEF DESCRIPTION OF THE DRAWINGS

The above and other objects and features of the invention will be apparent from the detailed description of the preferred embodiments of the invention, which is described and illustrated with reference to the accompanying drawings, in which;

FIG. 5 is a graph showing an example of changes in rotational speed of an engine in the case where the control device according to the embodiment of the present invention performs assist control during normal operation of the engine, and the case where a conventional control device performs assist control;

FIGS. 6A to 6C are graphs showing an example of changes in rotational speed during idling of the engine to which the control device according to the present invention is applied, with stroke changes of the engine;

FIG. 7A to 7C are graphs showing changes in rotational speed in the case where the control device according to the embodiment of the present invention performs assist control during idling of the engine, and the case where the assist control is not performed;

FIG. 9 is a flowchart showing another part of the algorithm of the processing performed by the microprocessor for comprising each means shown in FIG. 3 in the embodiment of the present invention.

DETAILED DESCRIPTION OF THE PREFERRED EMBODIMENT

Now, preferred embodiments of the present invention will be described with reference to the drawings.

Figure 1:
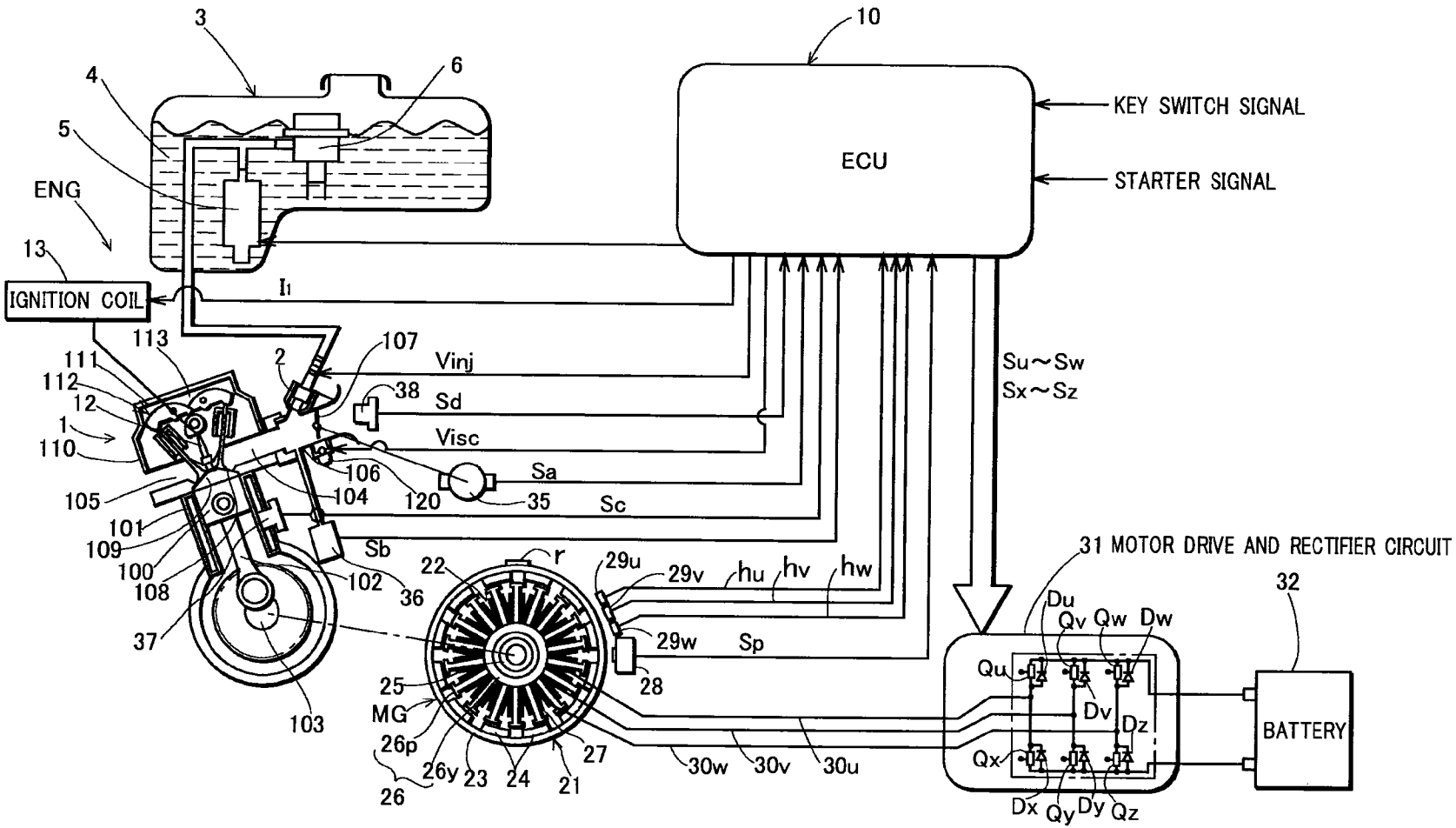
FIG. 1 is a block diagram of a construction of hardware of an engine system to which a control device according to the present invention is applied.

FIG. 1 shows a construction of an engine system including an engine starting device according to the present invention. In FIG. 1, ENG denotes a parallel two cylinder four cycle engine. Combustion cycles of a first cylinder and a second cylinder of the engine have a phase difference of 360°. A reference numeral 1 denotes an engine body, which includes two cylinders 101 (the first cylinder only is shown) having a piston 100 therein, and a crankshaft 103 connected to the piston 100 in the cylinder via a connecting rod 102.

The engine body 1 includes an intake port 104 and an exhaust port 105, and an intake pipe 106 is connected to the intake port 104. A throttle valve 107 is provided in the intake pipe 106, and an intake valve 108 and an exhaust valve 109 are provided so as to open and close the intake port 104 and the exhaust port 105, respectively. A cam cover 111 is mounted to an upper portion of a cylinder head 110 of the engine body, and inside the cam cover 111, a cam chamber 113 housing a cam mechanism 112 for driving the intake valve 108 and the exhaust valve 109 is provided.

The engine ENG includes a fuel injection device that injects fuel for generating an air/fuel mixture to be supplied into the cylinder 101 through the intake pipe 106, an ignition device that ignites the air/fuel mixture compressed in the cylinder 101, and a starter motor that can rotationally drive the crankshaft 103 in forward and reverse directions.

In the shown example, an injector (electromagnetic fuel injection valve) 2 is mounted so as to inject fuel into an intake pipe or an intake port downstream of the throttle valve 107. Fuel is supplied into the injector 2 from a fuel pump 5 that pumps fuel 4 in a fuel tank 3. A pressure of the fuel supplied from the fuel pump 5 to the injector 2 is maintained constant by a pressure regulator 6. A solenoid of the injector 2 is connected to an injector drive circuit provided in an electronic control unit (ECU) 10. The injector drive circuit is a circuit that supplies a driving voltage to the solenoid of the injector 2 when an injection command signal is generated in the ECU. The injector 2 opens a valve and injects fuel into the intake pipe while a driving voltage Vinj is supplied from the injector drive circuit to the solenoid. When the pressure of the fuel supplied to the injector is maintained constant, an injection amount of the fuel is controlled by an injection time (a time during which the valve of the injector is opened).

In this example, the fuel injection device is comprised of the injector 2, the unshown injector drive circuit, a fuel injection control portion that gives an injection command to the injector drive circuit, and the fuel pump 5.

To the cylinder head of the engine body, an ignition plug 12 for each cylinder is mounted with a discharge gap at a tip thereof facing a combustion chamber in each cylinder 101.

The ignition plug for each cylinder is connected to a secondary side of an ignition coil 13 for each cylinder. A primary side of the ignition coil 13 for each cylinder is connected to an unshown ignition circuit provided in the ECU 10.

The ignition circuit is a circuit that suddenly changes a primary current I1 of the ignition coil 13 to induce a high voltage for ignition on the secondary side of the ignition coil 13 when an ignition command is given from an ignition command issuing portion.

The ignition device that ignites the engine is comprised of the ignition plug 12, the ignition coil 13, the unshown ignition circuit, and the ignition command issuing portion that gives the ignition command to the ignition circuit. The ignition command issuing portion is comprised of a normal time ignition control portion that arithmetically operates an ignition position during normal operation of the engine and issues an ignition command when the arithmetically operated ignition position is detected, and a start time ignition control portion that issues an ignition command at an ignition position suitable for starting the engine at the start of the engine.

In the engine in FIG. 1, an ISC (Idle Speed Control) valve 120 is provided that is operated by the solenoid so as to bypass the throttle valve. An ISC valve drive circuit that provides a drive signal Visc to the ISC valve 120 is provided in the ECU 10, and the drive signal Visc is provided from the ISC valve drive circuit to the ISC valve 120 so as to maintain a constant idling speed of the engine.

In the embodiment, a rotating electric machine (referred to as a motor-generator) MG, which is driven as a motor at the start of the engine and when the engine is assisted and operated as a generator during operation of the engine and when the engine does not need to be assisted, is mounted to the engine. The rotating electric machine MG is comprised of a rotor 21 mounted to the crankshaft 103 of the engine, and a stator 22 secured to a case or the like of the engine body.

The rotor 21 is comprised of a cup-like ferrous rotor yoke 23, and permanent magnets 24 mounted to an inner periphery thereof. In this example, the permanent magnets 24 mounted to the inner periphery of the rotor yoke 23 produce 12-pole magnetic fields. The rotor 21 is mounted to the crankshaft 103 by fitting a tapered portion at a tip of the crankshaft 103 of the engine in a tapered hole formed in a boss 25 provided at the center of a bottom wall portion of the rotor yoke 23, and fastening the boss 25 to the crankshaft 103 by a screw member.

The stator 22 is comprised of a stator iron core 26 having a structure with 18 salient pole portions 26*p* radially protruding from an outer periphery of an annular yoke 26*y*, and an armature coil 27 wound around the series of salient pole portions 26*p* of the stator iron core and three-phase connected, and a magnetic pole portion at a tip of each salient pole portion 26*p* of the stator iron core 26 faces a magnetic pole portion of the rotor with a predetermined gap therebetween. A reluctor r constituted by an arcuate protrusion is formed on an outer periphery of the rotor yoke 23, and a pulse signal generator 28 that detects a leading edge and a trailing edge in a rotational direction of the reluctor r to generate pulses having different polarities is mounted to a case side of the engine.

Hall sensors 29*u* to 29*w* such as Hall ICs, which are placed in detection positions set for the three phases of the armature coil and detect polarities of the magnetic poles of the magnetic fields of the rotor 21, are provided on a stator side of the motor-generator MG. In FIG. 1, the three-phase Hall sensors 29*u* to 29*w* are shown placed outside the rotor yoke 23, but actually, the three-phase Hall sensors 29*u* to 29*w* are placed inside the rotor 21 and mounted to a printed circuit board secured to the stator 22. The Hall sensors are provided in the same manner as in a general three-phase brushless motor. The Hall sensors 29*u* to 29*w* output position detection signals hu to hw that are voltage signals having different levels between when the detected magnetic pole is a north pole and when the detected magnetic pole is a south pole.

Instead of providing the Hall sensors so as to directly detect the polarities of the magnetic poles of the magnetic fields of the rotor 21, the Hall sensors may be provided so that permanent magnets for detecting rotor magnetic poles magnetized with magnetic poles arranged in the same manner as the magnetic poles of the magnetic fields of the rotor 21 are mounted outside the rotor yoke 23 (for example, outside an end wall of the rotor yoke), and the magnetic poles of the permanent magnets for detecting rotor magnetic poles are detected outside the rotor 21.

In the present invention, the Hall sensors 29*u* to 29*w* are also used as crank angle sensors that generate a crank angle detection signal at each specific crank angle position that appears every time the crankshaft of the engine rotates in an instantaneous speed detection section set to be sufficiently narrower than a crank angle section corresponding to each stroke of a combustion cycle of the engine.

The three-phase armature coil of the motor-generator MG is connected to AC terminals of a motor drive and rectifier circuit 31 through wires 30*u* to 30*w*, and a battery 32 is connected across DC terminals of the motor drive and rectifier circuit 31. The motor drive and rectifier circuit 31 is a known circuit including a bridge type three-phase inverter circuit (motor drive circuit) in which switch elements Qu to Qw and Qx to Qz that can be controlled on/off such as MOSFETs or power transistors form sides of a three-phase H bridge, and a diode bridge three-phase full-wave rectifier circuit comprised of diodes Du to Dw and Dx to Dz connected in anti-parallel with the switch elements Qu to Qw and Qx to Qz of the inverter circuit.

When the motor-generator MG is operated as the motor, the switch elements of the inverter circuit are controlled on/off according to a rotational angle position of the rotor 21 detected from outputs of the Hall sensors 29*u* to 29*w*, and thus a driving current that is commutated in a predetermined phase order is supplied from the battery 32 through the inverter circuit to the three-phase armature coil 27. The motor-generator is driven as the motor in the same manner as a known three-phase brushless motor.

When the motor-generator MG is operated as the generator after the start of the engine, a three-phase AC output obtained from the armature coil 27 is supplied through the full-wave rectifier circuit in the motor drive and rectifier circuit 31 to the battery 32 and various loads (not shown) connected across the battery 32. At this time, the switch elements that form an upper side or a lower side of the bridge of the inverter circuit are simultaneously controlled on/off according to the voltage across the battery 32, and thus the voltage across the battery 32 is controlled so as not to exceed a set value. For example, when the voltage across the battery 32 is the set value or less, the switch elements Qu to Qw and Qx to Qz that form the H bridge of the inverter circuit are maintained in an off state, and the output of the rectifier circuit in the motor drive and rectifier circuit 31 is applied as it is to the battery 32. When the voltage across the battery 32 exceeds the set value, the three switch elements Qx to Qz that form three lower sides (or upper sides) of the bridge of the inverter circuit are simultaneously turned on, and thus the three-phase AC output of the generator is short-circuited to reduce the voltage across the battery 32 to the set value or less. Repeating these operations allows the voltage across the battery 32 to be maintained at around the set value.

When MOSFETs are used as the switch elements that form the sides of the bridge of the inverter circuit, parasitic diodes formed between drains and sources of the MOSFETs can be used as the diodes Du to Dw and Dx to Dz.

In the shown example, in order to provide information on the engine to the microprocessor in the ECU 10, there are provided a throttle position sensor 35 that detects a position (an opening degree) of the throttle valve 107, a pressure sensor 36 that detects an internal pressure of an intake pipe downstream of the throttle valve 107, a cooling water temperature sensor 37 that detects a cooling water temperature of the engine, and an intake air temperature sensor 38 that detects a temperature of air taken in by the engine.

Figure 2:
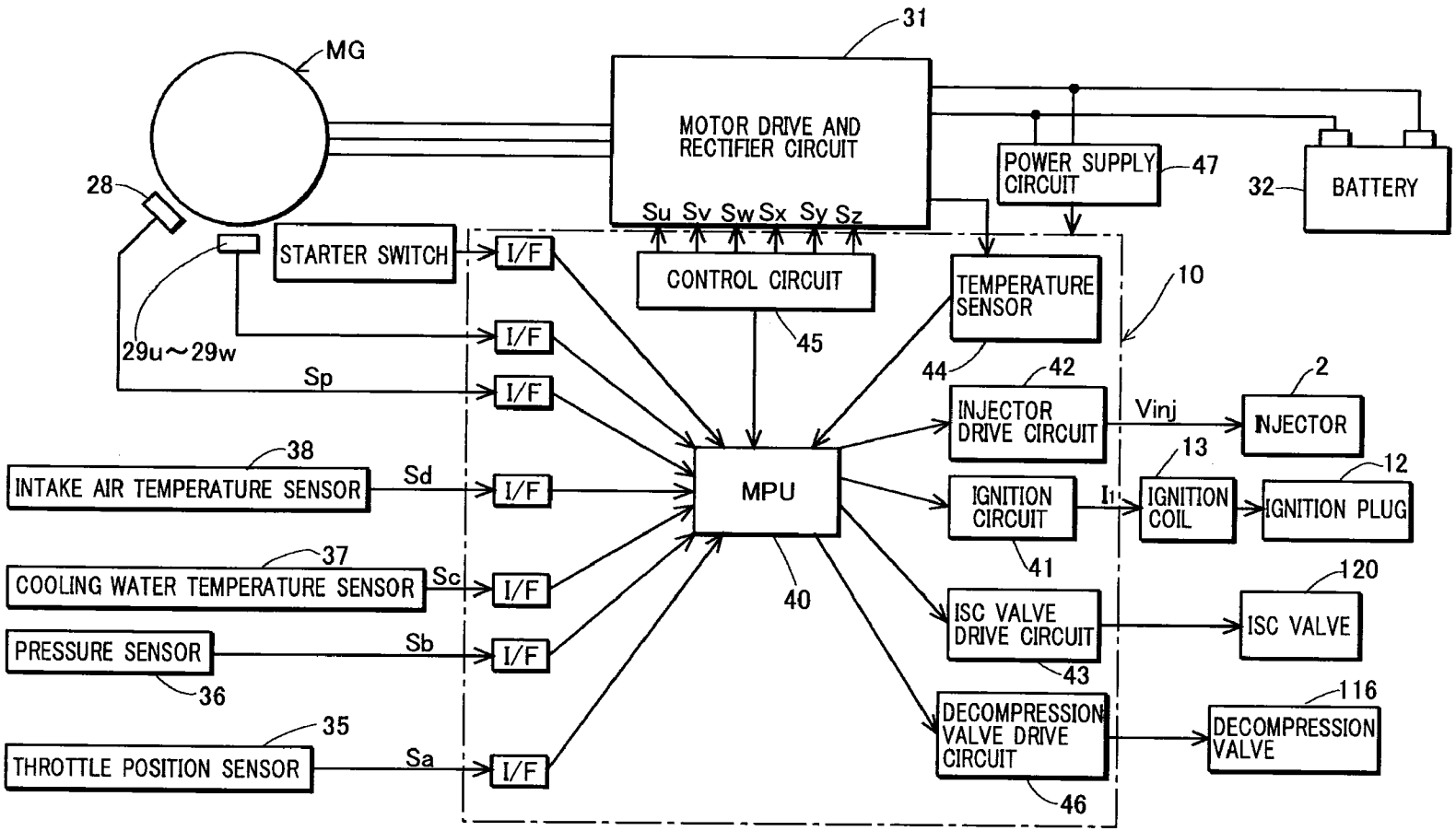
FIG. 2 is a block diagram of an electrical construction of the system in FIG. 1.

FIG. 2 is a block diagram of an electrical construction of the system in FIG. 1. The ECU 10 includes a microprocessor (MPU) 40, an ignition circuit 41, an injector drive circuit 42, an ISC valve drive circuit 43, a temperature sensor 44 that detects a temperature of the motor drive and rectifier circuit 31, a control circuit 45 that provides drive signals to the switch elements of the inverter circuit of the motor drive and rectifier circuit 31 according to commands given from the microprocessor 40, and a predetermined number of interface circuits I/F.

The microprocessor 40 performs predetermined programs stored in a ROM to comprise various control means required for controlling the engine. In the shown example, in order to provide information on the engine to the microprocessor 40, a throttle position signal Sa obtained from the throttle position sensor 35, an intake pipe internal pressure detection signal Sb obtained from the pressure sensor 36, a cooling water temperature detection signal Sc obtained from the cooling water temperature sensor 37, and an intake air temperature detection signal Sd obtained from the intake air temperature sensor 38 are input to the microprocessor in the ECU 10 through the interface circuits I/F. The output signals hu to hw of the Hall sensors 29*u* to 29*w*, an output Sp of the pulse signal generator 28, a voltage detection signal and a current detection signal obtained from a voltage sensor 33*a* and a current sensor 33*b* are input to the microprocessor 40 through predetermined interface circuits I/F.

The ignition circuit 41 in the ECU 10 supplies the primary current I1 to the ignition coil 13, and the injector drive circuit 42 in the ECU 10 supplies the driving voltage Vinj to the injector 2. The control circuit 45 provides drive signals (signals for turning on the switch elements) Su to Sw and Sx to Sz to the six switch elements Qu to Qw and Qx to Qz, respectively, of the inverter circuit of the motor drive and rectifier circuit 31.

In FIG. 2, a reference numeral 47 denotes a power supply circuit to which an output voltage of the battery 32 is input. The power supply circuit 47 reduces and stabilizes the output voltage of the battery 32 to output a power supply voltage to be supplied to each component of the ECU 10.

Figure 3:
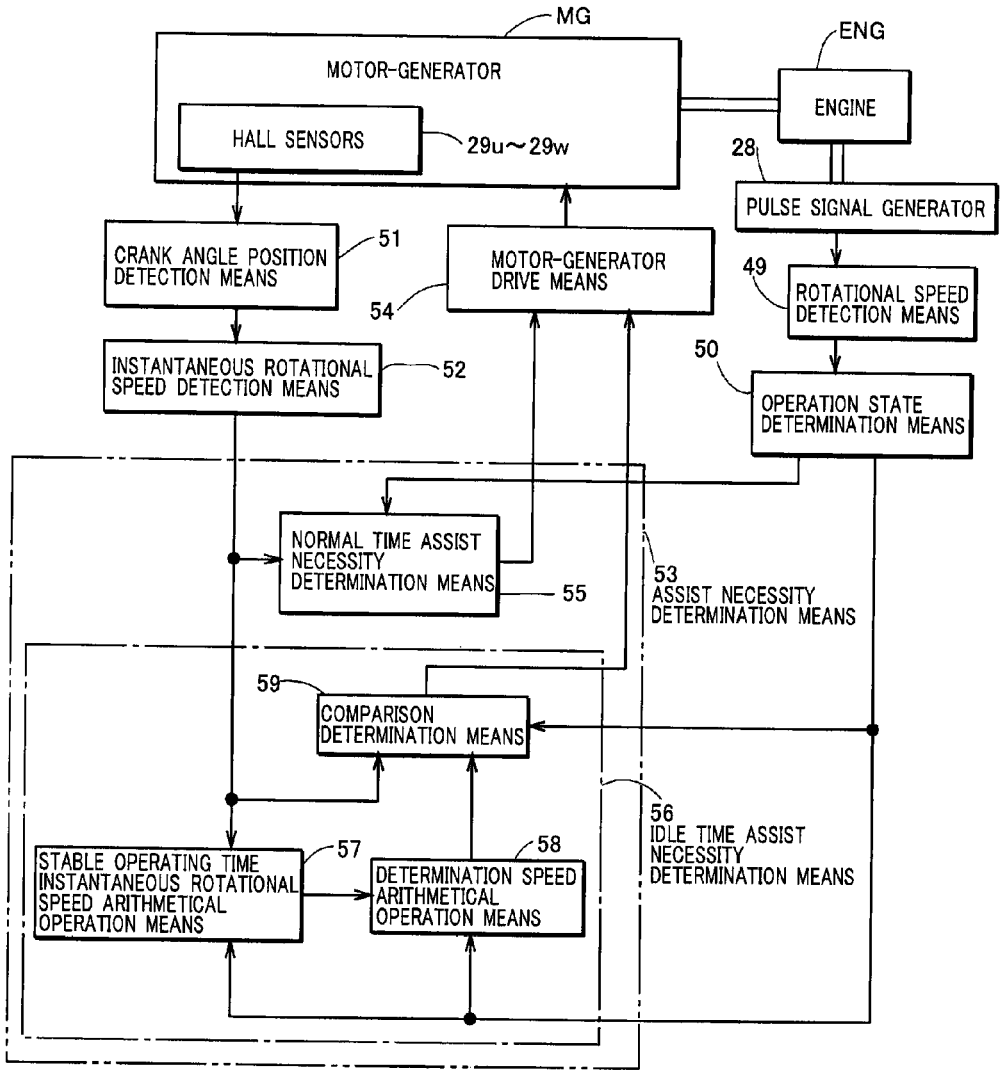
FIG. 3 is a block diagram of a construction of essential portions of the control device according to the present invention.

FIG. 3 is a schematic block diagram of a construction of components that perform control to assist the engine with the motor in the engine control device of the embodiment. In FIG. 3, a reference numeral 50 denotes operation state determination means for determining whether the engine is in an idling state or a normal operation state. The operation state determination means determines that the engine is in the idling state when an average rotational speed of the engine detected by rotational speed detection means 49 is an idle setting speed or lower and the throttle valve is in a fully-closed position continuously for a predetermined time, and determines that the engine is in a normal state (an operation state other than the idling state) when at least one of these conditions is not satisfied. The rotational speed detection means 49 detects the average rotational speed of the engine from a generation cycle (a time required for the crankshaft of the engine to rotate one turn) of a pulse signal generated at a set crank angle position by the pulse signal generator 28 mounted to the engine.

The ECU 10 includes an idle control portion that controls the ISC valve 120 so as to maintain the rotational speed of the engine at the idle setting speed during idling of the engine. The idle setting speed is set to a different value according to a gear position of a transmission provided between the crankshaft of the engine and the propeller. The idle setting speed when a shift lever of the transmission is in a neutral position is a preset value according to a temperature of the engine or the amount of power generated when the motor-generator is operated as the generator (so that the battery is charged also during idling). The idle setting speed when the shift lever of the transmission is in the neutral position is the same as the idle setting speed set in general engine control.

When the shift lever of the transmission is in an "advance" position (during so-called trolling), the idle setting speed is selected by a ship operator for fine adjustment of a ship speed during trolling. For switching the idle setting speed when the shift lever of the transmission is in the "advance" position, an idle speed setting device (not shown) that sets the idle setting speed is provided in the idle control portion so that the idle speed setting device can switch the idle setting speed. The idle setting speed is arbitrarily set within a range of, for example, 500 to 1000 r/min.

A reference numeral 51 denotes crank angle position detection means, which is comprised so as to detect, as a specific crank angle position, a crank angle position that appears every time the crankshaft of the engine rotates in a unit section set to be sufficiently narrower than a crank angle section corresponding to each stroke of the combustion cycle of the engine. In the embodiment, the crank angle position detection means is comprised of the Hall sensors 29*u* to 29*w* provided on the stator side of the motor-generator MG, and a process of performing a processing for obtaining information on the crank angle position from the output signals of the Hall sensors using the microprocessor.

Figures 4A, 4B, 4C, 4D, 4E:
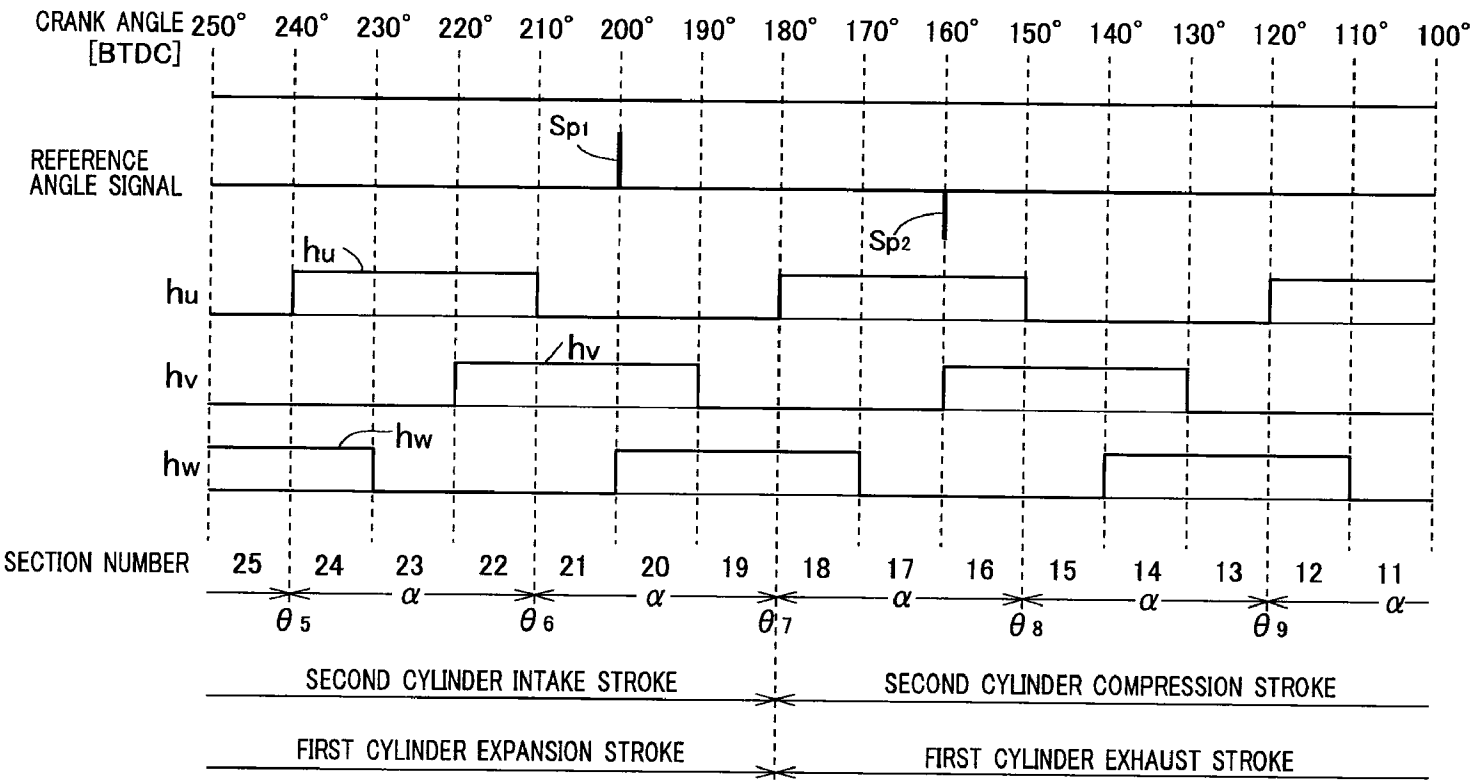
FIGS. 4A to 4E are schematic waveform charts showing waveforms of output pulses of a signal generator and waveforms of output signals of Hall sensors used in the embodiment of the present invention.

In the case where a 12-pole (6 pairs of poles) magneto rotor is used as the rotor of the motor-generator MG, when Hall ICs are used as the three-phase Hall sensors 29*u* to 29*w*, the sensors 29*u* to 29*w* generate the position detection signals hu to hw having waveforms as shown in FIGS. 4C to 4E, and any of the position detection signals hu to hw changes from a high level (H level) to a low level (L level) or from the low level to the high level for every 10° change of the crank angle. In the embodiment, the H level and the L level of the position detection signals hu to hw are indicated by "1" and "0", and level changes of the position detection signals are used as crank angle detection signals. Unit sections of 10° are detected from changes in level pattern of the position detection signals, and it is identified which of the crank angle positions of the engine these unit sections correspond to by using the output pulse of the pulse signal generator 28.

In the embodiment, the pulse signal generator 28 detects an edge of the reluctor r to generate a pulse when the piston is located near the bottom dead center, that is, in a section where load torque of the engine is relatively low so that the pulse signal generator 28 can generate a pulse with as high peak value as possible at the start. Specifically, as shown in FIG. 4B, the pulse signal generator 28 is provided so as to detect a leading edge and a trailing edge in the rotational direction of the reluctor r to generate a pulse Sp1 having a positive polarity and a pulse Sp2 having a negative polarity at positions of 200° and 160° before the top dead center of the compression stroke of the second cylinder, and it is identified which of the crank angle positions of the engine the series of unit sections detected by changes in output pattern of the Hall sensors correspond to with reference to one of the pulses Sp1 and Sp2.

In the shown example, as indicated at the bottom in FIG. 4, a unit section of 10° (a section from a position where the pattern of the position detection signals hu, hv, hw is 0, 1, 1 to a position where the pattern is 0, 0, 1) detected immediately after the pulse signal generator 28 generates the pulse Sp1 is denoted by a section number "20", thereafter the section number is reduced by one for every change in the output pattern of the Hall sensors. When the section number becomes 1, the next section number is 72, and thus 72 unit sections detected during two turns of the crankshaft (during one combustion cycle) are denoted by section numbers 1 to 72 to identify a relationship between the series of unit sections and the crank angle positions of the engine.

If the relationship between the series of unit sections detected from the changes in the output pattern of the Hall sensors and the present crank angle position of the engine can be once identified, thereafter the section number can be changed for every change in the output pattern of the Hall sensors to maintain the relationship between each unit section and the crank angle position of the engine, and crank angle information of the engine used for controlling an ignition position of the engine or the like can be obtained from each boundary position between unit sections (a crank angle position that appears every time the crankshaft rotates 10°).

As described later, in the present invention, each crank angle position that appears every time the crankshaft of the engine rotates in an instantaneous speed detection section set to be sufficiently narrower than a crank angle section corresponding to each stroke of a combustion cycle as a specific crank angle position, and data indicating the instantaneous rotational speed of the engine is obtained every time each specific crank angle position is detected. It is determined whether the engine needs to be assisted on the basis of the data, and when the engine needs to be assisted, the motor-generator is driven as the motor to assist the engine.

For higher detection accuracy of the instantaneous rotational speed, a smaller angle of the instantaneous speed detection section is preferable. However, too small an angle of the instantaneous speed detection section requires frequent interruptions of processings by the microprocessor for arithmetically operating the instantaneous rotational speed, or determining whether the engine needs to be assisted, which increases a time for processings required for assist control of the engine, and may cause a shortage of an arithmetical operation processing time for performing other control required for maintaining the operation of the engine such as control of ignition timing or a fuel injection amount. The angle of the instantaneous speed detection section (an angle between specific crank angle positions that appear every time the crankshaft rotates one turn) is set in view of an arithmetical operation processing time assigned to the assist control of the engine, the detection accuracy of the instantaneous rotational speed, and accuracy of the assist control, or the like.

In the embodiment, among the crank angle positions (level change positions) where the outputs of the Hall sensors 29*u* to 29*w* change their levels, a level change position that appears every two positions is used as a specific crank angle position, and an angle α of each instantaneous speed detection section is 30°. Specifically, a section where the output signal hu of the U-phase Hall sensor is a low level and a section where the output signal hu is a high level are instantaneous speed detection sections, a boundary position between a 30° section including three unit sections with the section number 21 to 19 and a 30° section including three unit sections with the section numbers 18 to 16 is a specific crank angle position θ7 corresponding to a bottom dead center position of an expansion stroke of the first cylinder, and the series of crank angle positions shifted successively by 30° from the specific crank angle position are specific crank angle positions θ8, θ9, . . . , and a total of 24 specific crank angle positions are set in a crank angle range of 720° where one combustion cycle of the engine is performed.

When the 30° section is used as the instantaneous speed detection section, and the boundary position between the adjacent instantaneous speed detection sections is the specific crank angle position, it is only necessary that each instantaneous speed detection section is identified using one of three numbers for identifying three unit sections that constitute each instantaneous speed detection section. For example, it is only necessary that the instantaneous speed detection section between the specific crank angle positions θ7 and θ8 is specified by any of the three section numbers 16 to 18. Which of the section numbers is used to specify each instantaneous speed detection section may be determined when a program to be performed by the microprocessor for performing a processing for detecting the specific crank angle position is prepared.

A reference numeral 52 denotes instantaneous rotational speed detection means for detecting, as an instantaneous rotational speed of the engine, a rotational speed detected from a time period between when the last specific crank angle position is detected and when this specific crank angle position is detected, every time the crank angle position detection means 51 detects each specific crank angle position, and storing data including information on the detected instantaneous rotational speed.

As the data indicating the instantaneous rotational speed of the engine, data itself on a time measured by a timer of the microprocessor while the crankshaft rotates in each instantaneous speed detection section (a time required for the crankshaft to rotate in each instantaneous speed detection section) may be used, or data on a rotational speed arithmetically operated from the measured time and the angle α of the instantaneous speed detection section may be used. For a quicker arithmetical operation processing, the time itself measured by the timer while the crankshaft rotates in each instantaneous speed detection section is preferably used as the data indicating the instantaneous rotational speed.

In FIG. 3, a reference numeral 53 denotes assist necessity determination means for determining whether a drive force needs to be externally applied to the crankshaft of the engine to assist the engine, from the degree of reduction in the instantaneous rotational speed detected by the instantaneous rotational speed detection means 52, and 54 denotes motor-generator drive means for driving the motor-generator so as to apply the drive force from the motor-generator MG to the engine ENG when the assist necessity determination means 53 determines that the engine needs to be assisted.

Whether the engine needs to be assisted is determined on the basis of the reduction in the instantaneous rotational speed in such a manner that, for example, it is determined that the engine needs to be assisted when a reduction in the instantaneous rotational speed of the engine to an assist start rotational speed or lower set to be lower than an average rotational speed required for stable rotation of the engine is detected, and it is determined that the engine does not need to be assisted any longer when the rotational speed of the engine is restored to an assist end rotational speed set to be higher than the assist start rotational speed. As described later, in the embodiment, different determination speeds are used for determining whether the engine needs to be assisted between during idling and during other operations (during normal operation).

Thus, in the embodiment, the assist necessity determination means 53 is comprised of normal time assist necessity determination means 55 for determining whether the engine needs to be assisted during normal operation with the rotational speed of the engine higher than an idle setting speed, and idle time assist necessity determination means 56 for determining whether the engine needs to be assisted during idling of the engine.

The normal time assist necessity determination means 55 is comprised so as to determine that the engine needs to be assisted when the instantaneous rotational speed detected by the instantaneous rotational speed detection means 52 becomes the normal time assist start speed or lower set to a certain value irrespective of the crank angle position, and maintain the state of determination that the engine needs to be assisted until the instantaneous rotational speed detected by the instantaneous rotational speed detection means becomes the assist end speed or higher set to be higher than the normal time assist start speed once it is determined that the engine needs to be assisted.

The idle time assist necessity determination means 56 is comprised so as to determine that the engine needs to be assisted when the instantaneous rotational speed detected at each specific crank angle position by the instantaneous rotational speed detection means is an idle time assist start speed or lower set to be lower than a stable operating time instantaneous rotational speed during idling at each specific crank angle position, and maintain the state of determination that the engine needs to be assisted until it is detected that the instantaneous rotational speed of the engine detected at each specific crank angle position becomes the stable operating time instantaneous rotational speed during idling at the specific crank angle position once it is determined that the engine needs to be assisted.

The shown idle time assist necessity determination means 56 includes stable operating time instantaneous rotational speed arithmetical operation means 57 for arithmetically operating an average value of instantaneous rotational speeds detected at each specific crank angle position by the instantaneous rotational speed detection means 52 in a plurality of past combustion cycles as a stable operating time instantaneous rotational speed at each specific crank angle position during idling of the engine, determination speed arithmetical operation means 58 for subtracting a certain value ΔN from the stable operating time instantaneous rotational speed arithmetically operated by the stable operating time instantaneous rotational speed arithmetical operation means 57, and arithmetically operating an idle time assist start speed set to be lower by the certain value ΔN than the stable operating time instantaneous rotational speed during idling at each specific crank angle position, and comparison determination means 59 for comparing the instantaneous rotational speed with the idle time assist start speed, determine that the engine needs to be assisted when the instantaneous rotational speed is the idle time assist start speed or lower, and maintain the state of determination that the engine needs to be assisted until it is detected that the instantaneous rotational speed detected at each specific crank angle position becomes the stable operating time instantaneous rotational speed or higher during idling at the specific crank angle position once it is determined that the engine needs to be assisted. The value ΔN is set to an accurate value on the basis of an experiment result.

Control operation in the case where the engine control device is comprised as in FIG. 3 will be described. The instantaneous rotational speed detection means 52 stores, as data including information on the instantaneous rotational speed of the engine, a time period between when the last crank angle detection signal is generated and when this crank angle detection signal is generated, every time the crank angle sensor 51 generates a crank angle detection signal at each crank angle position. When the operation state determination means 50 determines that the engine is not in an idling state but in a normal operation state, the normal time assist necessity determination means 55 compares the instantaneous rotational speed detected by the instantaneous rotational speed detection means 52 with the normal time assist start speed, and determine whether the instantaneous rotational speed is the normal time assist start speed or lower. When it is determined that the instantaneous rotational speed exceeds the normal time assist start speed, the engine does not need to be assisted, and the motor-generator MG is operated as the generator.

The instantaneous rotational speed is compared with the normal time assist start speed, and when it is determined that the instantaneous rotational speed is the normal time assist start speed or lower, the engine needs to be assisted, and the normal time assist necessity determination means 55 gives a motor driving command to the motor-generator drive means 54. At this time, the motor-generator drive means 54 passes a driving current that is commutated in a predetermined phase order through the armature coil of the motor-generator on the basis of the information on the rotational angle position of the rotor obtained from the detection signals of the Hall sensors of the motor-generator MG. Thus, the motor-generator MG is driven as the motor to apply torque in a direction of assisting the rotation of the engine from the motor to the crankshaft of the engine.

Thus, for example, when the shift lever is switched from the advance position to the retraction position for avoiding risk during navigation of the ship, the load on the engine is suddenly increased, and the rotational speed of the engine is reduced to the extent that may cause the engine to stall, the normal time assist necessity determination means 55 can determine that the engine needs to be assisted to cause the motor-generator to assist the engine.

FIG. 5 shows changes in rotational speed of the engine in the case where it is determined whether the engine needs to be assisted on the basis of an average rotational speed of the engine to assist the engine as is conventional, and the case where it is determined whether the engine needs to be assisted on the basis of the instantaneous rotational speed of the engine to assist the engine as in the present invention. In FIG. 5, curves a and b indicate a change in rotational speed in the case where it is determined whether the engine needs to be assisted on the basis of the instantaneous rotational speed to assist the engine and a change in rotational speed in the case where it is determined whether the engine needs to be assisted on the basis of the average rotational speed of the engine to assist the engine, respectively, and a curve c indicates a change in rotational speed when the engine is not assisted. Nav denotes an average rotational speed during one turn of the engine, and Nas and Nae denote a normal time assist start speed and an assist end speed, respectively.

In the case where the assist control of the engine is not performed, when the shift lever is switched from the advance position to the retraction position and the load is suddenly increased, the rotational speed of the engine is reduced as shown by the curve c in FIG. 5, and the engine may stall.

As disclosed in Japanese Patent Application Laid-Open Publication No. 6-213112, in the case where it is determined whether the engine needs to be assisted on the basis of the average rotational speed of the engine to assist the engine, the motor-generator is driven to start assisting the engine when it is detected that the average rotational speed Nav becomes the assist start rotational speed Nas or lower at a crank angle position θx as shown by the curve b in FIG. 5. Thus, as shown by the curve b, the rotational speed is restored, but it takes time to detect that the average rotational speed Nav of the engine becomes the assist start rotational speed Nas or lower, which inevitably delays the start of assisting.

On the other hand, as in the present invention, in the case where it is determined whether the engine needs to be assisted on the basis of the instantaneous rotational speed of the engine to assist the engine, when the instantaneous rotational speed becomes the assist start rotational speed Nas or lower at a crank angle position θa, it is detected that the instantaneous rotational speed becomes the assist start rotational speed Nas or lower at a specific crank angle position θn immediately after the crank angle position θa, and it is determined that the engine needs to be assisted. Thus, the engine is quickly assisted to restore the rotational speed of the engine in a short time as shown by the curve a. When the instantaneous rotational speed of the engine exceeds the assist end rotational speed Nae at a crank angle position θb after the engine starts to be assisted at the crank angle position θn, it is detected that the instantaneous rotational speed exceeds the assist end rotational speed Nae at a specific crank angle position θn' immediately after the crank angle position θb. Thus, the driving of the motor-generator by the motor-generator drive means 54 is stopped to finish assisting the engine.

According to the present invention, the engine starts to be assisted when the instantaneous value of the rotational speed of the engine becomes the assist start rotational speed or lower, and thus the engine can be quickly started to be assisted when the engine enters a state where the engine needs to be assisted by the motor. This can reliably prevent the engine from stalling when the shift lever is switched from the advance position to the retraction position.

Then, it is supposed that the idle determination means 50 determines that the engine is in the idling state. When the engine is in the idling state, as shown in FIG. 6, the rotational speed of the engine minutely changes with load changes caused by stroke changes of the engine. In FIG. 6A, the curve a indicates an actual rotational speed of the engine, and the straight line b indicates an average rotational speed of the engine (in the shown example, 800 rpm). In the shown example, the average rotational speed of the engine is 800 rpm, and thus the crankshaft of the engine rotates one turn in 0.075 (=60/800) sec.

FIGS. 6B and 6C show stroke changes of first and second cylinders of the engine, and "EXPANSION", "EXHAUST", "INTAKE" and "COMPRESSION" denote an expansion stroke, an exhaust stroke, an intake stroke and a compression stroke, respectively. In this example, an angle of a unit section is 30°, and 24 specific crank angle positions θ1, θ2, . . . , θ24 are set in sections of one combustion cycle so that each stroke of the engine is divided into equal six unit sections.

The microprocessor 40 in the ECU 10 controls the ISC valve 120 (see FIG. 1) provided in parallel with the throttle valve so as to maintain the rotational speed of the engine at the idle setting speed (800 rpm in the example in FIG. 6) during idling of the engine. Control of the ISC valve is known and detailed descriptions thereof will be omitted.

During idling, unstable fuel combustion is performed in the cylinder of the engine, and low torque is generated by the engine, and thus a slight load change may cause the engine to stall. Particularly, if the ship operator switches the idle setting speed to a low value in trolling, idling of the engine becomes unstable to increase the possibility that the engine stalls. For example, if the idle setting speed is reduced to 500 rpm as shown by the curve a in FIG. 7A, the rotational speed starts to be reduced as shown by the broken line curve b in FIG. 7A when a piston in any of the cylinders approaches the top dead center of the compression stroke, and finally the engine may stall. In the shown example, the instantaneous rotational speed of the engine starts to be reduced at a specific crank angle position θ1 that is the top dead center of the piston when the compression stroke of the second cylinder finishes.

Thus, in order to allow the idle setting speed to be switched to a low value in trolling, the assist control of the engine needs to have quicker response than during normal operation, and it is necessary to determine that the engine needs to be assisted from changes in the instantaneous rotational speed of the engine as quickly and accurately as possible.

During idling, the rotational speed of the engine minutely changes with stroke changes, and thus it cannot be determined whether the engine needs to be assisted by comparing the instantaneous rotational speed of the engine with a certain determination value. Thus, in the embodiment, the instantaneous rotational speed at each specific crank angle position while the engine is stably idling is used as the stable operating time instantaneous rotational speed during idling, and when it is detected that the instantaneous rotational speed of the engine becomes lower than the stable operating time instantaneous rotational speed by the certain value ΔN, it is determined that the engine needs to be assisted.

In FIG. 7A, the fine broken line part of the curve a indicates changes in rotational speed when it is assumed that idling is stably continued without a reduction in idling speed. In FIG. 7, an average value Nis (a stable operating time instantaneous rotational speed) of instantaneous rotational speeds over a plurality of combustion cycles referred to at each specific crank angle position (arithmetically operated at the same specific crank angle position in the last combustion cycle) is shown by a short horizontal line for each specific crank angle position.

In order to allow the idle setting speed to be set to a lower value than in conventional during idling, in the embodiment, the stable operating time instantaneous rotational speed arithmetical operation means 57 is provided for arithmetically operating an average value of instantaneous rotational speeds over a plurality of past successive combustion cycles (for example, 3 to 5 combustion cycles) at each specific crank angle position as a stable operating time instantaneous rotational speed (an instantaneous rotational speed at each specific crank angle position during stable idling of the engine) referred to at each specific crank angle position in the next combustion cycle, when the instantaneous rotational speed is detected at each specific crank angle position, and the stable operating time instantaneous rotational speed arithmetically operated by the arithmetical operation means at each specific crank angle position is stored for each specific crank angle position. The idle time assist start speed arithmetical operation means 58 is also provided for arithmetically operating a value obtained by subtracting the certain value ΔN from the stable operating time instantaneous rotational speed arithmetically operated at the same specific crank angle position in the last combustion cycle as the idle time assist start speed at each specific crank angle position when the instantaneous rotational speed is detected at each specific crank angle position, and the idle time assist start speed arithmetically operated by the arithmetical operation means 58 is provided to the comparison determination means 59 together with a newly detected instantaneous rotational speed.

When a new instantaneous rotational speed is detected at each specific crank angle position, the idle time assist start speed is arithmetically operated with reference to the stable operating time instantaneous rotational speed at each specific crank angle position arithmetically operated in the last combustion cycle, and the newly detected instantaneous rotational speed is compared with the idle time assist start speed. When the newly detected instantaneous rotational speed is the idle time assist start speed or lower, it is determined that the engine needs to be assisted to cause the motor-generator drive means 54 to start driving the motor-generator MG as the motor to start assisting the engine.

In the example in FIG. 7, at a specific crank angle position θ17 in the middle of the intake stroke of the first cylinder and the expansion stroke of the second cylinder, the instantaneous rotational speed becomes lower than the idle time assist start speed set to a value lower by the certain value ΔN than the average value of the instantaneous rotational speed (stable operating time instantaneous rotational speed) at the same specific crank angle position θ17 arithmetically operated in the last combustion cycle. Thus, at the specific crank angle position θ17, the engine starts to be assisted, and the rotational speed of the engine is restored as shown by the curve c.

As described above, it is determined that the engine needs to be assisted when the instantaneous rotational speed detected at each specific crank angle position is the idle time assist start speed or lower set to be lower than the stable operating time instantaneous rotational speed during idling at each specific crank angle position with reference to the stable operating time instantaneous rotational speed during idling at each specific crank angle position. Thus, it can be quickly and accurately determined whether the engine needs to be assisted to allow the engine to be assisted immediately when needed, and idling at a low speed can be stably performed without stalling the engine even when the output torque in a low speed rotation area of the engine is low.

As described above, the stable operating time instantaneous rotational speed arithmetical operation means is provided for arithmetically operating, as the stable operating time instantaneous rotational speed at each specific crank angle position, the average value of the instantaneous rotational speeds detected by the instantaneous rotational speed detection means at each specific crank angle position over the plurality of combustion cycles during idling of the engine. This allows determination whether the engine needs to be assisted with reference to the actual stable operating time instantaneous rotational speed of the engine, thus allows accurate assist control of the engine without being influenced by variations in characteristics of the engine, and prevents the engine from being stopped during idling.

Figure 8:
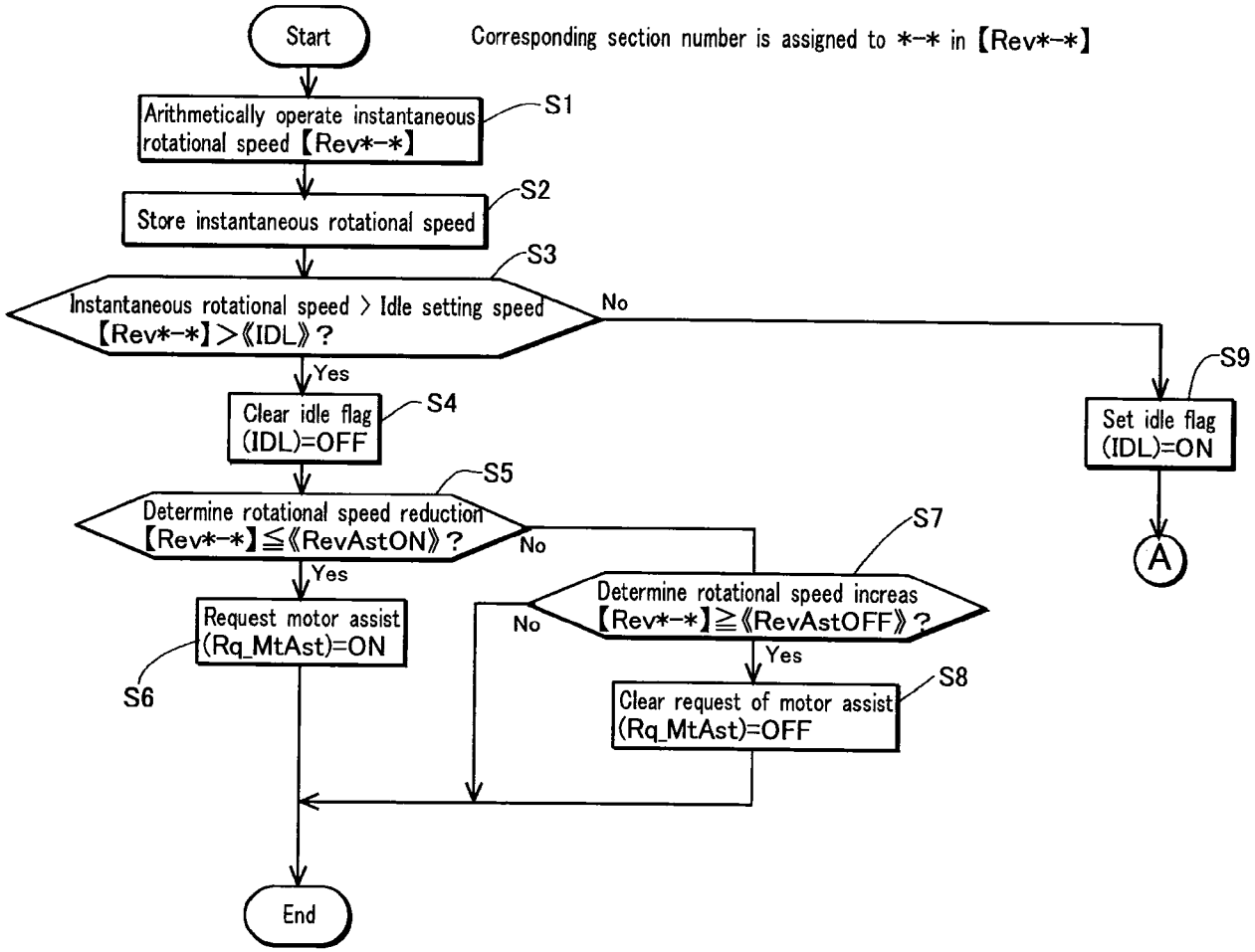
FIG. 8 is a flowchart showing a part of an algorithm of a processing performed by a microprocessor for comprising each means shown in FIG. 3 in the embodiment of the present invention.
Figure 10:
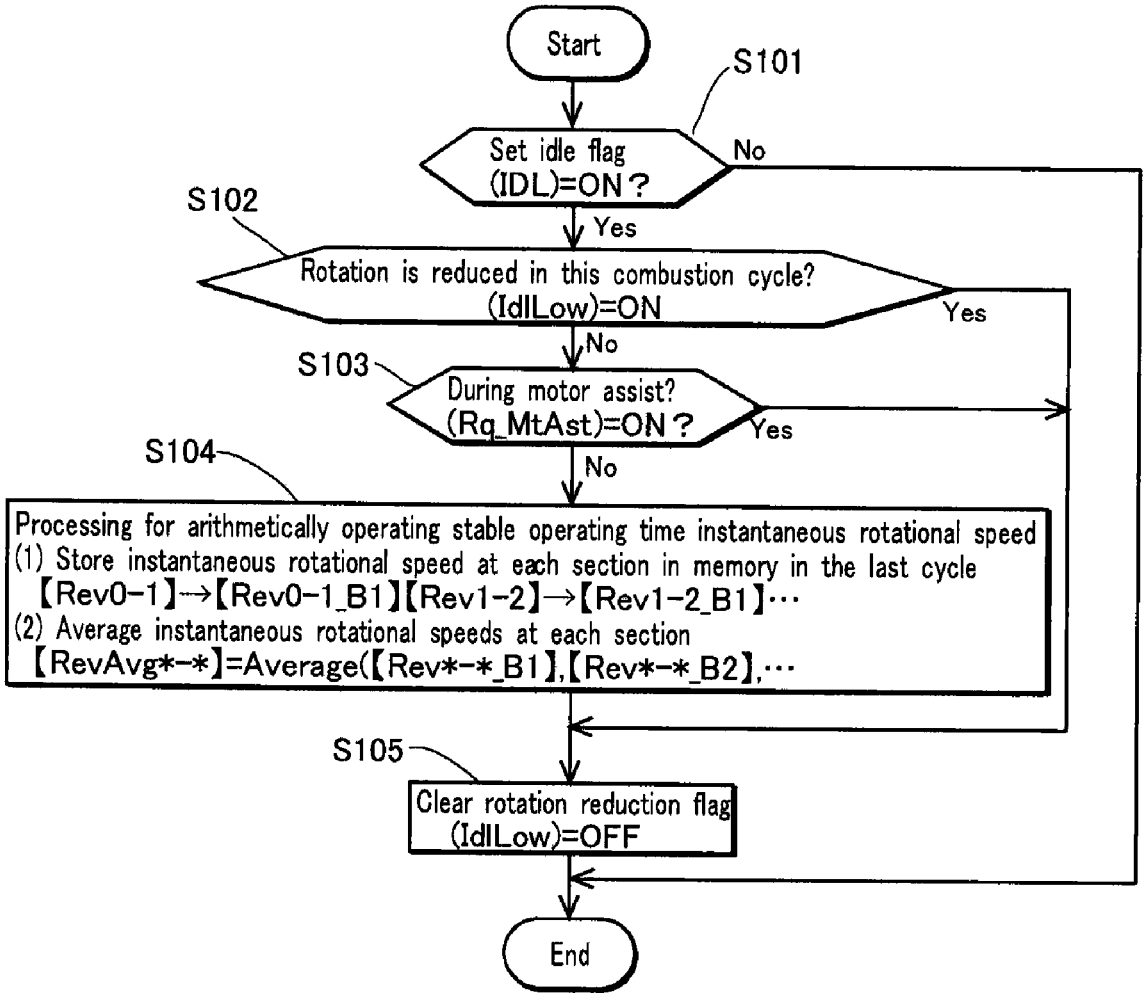
FIG. 10 is a flowchart of a further part of the algorithm of the processing performed by the microprocessor for comprising each means shown in FIG. 3 in the embodiment of the present invention.

Next, processings performed by the microprocessor for comprising the components of the control device in FIG. 3 will be described. FIGS. 8 and 9 show an interruption processing activated every time the crank angle sensor generates a crank angle detection signal at each specific crank angle position, and FIG. 10 shows an interruption processing performed once in one combustion cycle at a reference crank angle position where the pulse signal generator generates a pulse signal SP1.

In the processing in FIGS. 8 and 9 performed every time each specific crank angle position is detected, first in Step S1 in FIG. 8, an instantaneous rotational speed [ReV*-*] is arithmetically operated from a time period between when the last crank angle detection signal is generated and when this crank angle detection signal is generated, and in Step S2, the arithmetically operated instantaneous rotational speed is stored. Herein, *-* means a section number specifying an instantaneous rotational speed detection section immediately before each specific crank angle position.

After the instantaneous rotational speed at each specific crank angle position is stored in Step S2, in Step S3, the instantaneous rotational speed [Rev*-*] is compared with an idle setting speed <<IDL>>. When the instantaneous rotational speed [Rev*-*] is higher than the idle setting speed <IDL>>, in Step S4, an idle flag (IDL) is cleared (OFF). Then, in Step S5, the instantaneous rotational speed [Rev*-*] is compared with a normal time assist start speed <<RevAstON>>. When the instantaneous rotational speed [Rev*-*] is the normal time assist start speed <<RevAstON>> or lower, in Step S6, an assist request flag (Rq_MtAst) indicating that the engine needs to be assisted by the motor is set (ON), and this processing is finished.

When it is determined in Step S5 that the instantaneous rotational speed [Rev*-*] exceeds the normal time assist start speed <<RevAstON>>, in Step S7, the instantaneous rotational speed [Rev*-*] is compared with an assist end speed <<RevAstOFF>>. When it is determined that the instantaneous rotational speed [Rev*-*] is the assist end speed <<RevAstOFF>> or more, in Step S8, the assist request flag (Rq_MtAst) is cleared (OFF), and this processing is finished.

The motor-generator drive means 54 in FIG. 3 drives the motor-generator MG as a brushless motor to assist the engine while the assist request flag (Rq_MtAst) is set.

When it is determined in Step S3 in FIG. 8 that the instantaneous rotational speed [Rev*-*] is the idle setting speed <<IDL>> or less, in Step S9, an idle flag (IDL) indicating that the engine is in an idling state is set (ON), and then the process moves to Step S10 in FIG. 9. In Step S10, the instantaneous rotational speed [Rev*-*] is compared with an idle time assist start speed [RevAvg*-*]-<<DefAstON>> obtained by subtracting a certain value <<DefAstON>> from a stable operating time instantaneous rotational speed [RevAvg*-*] at each specific crank angle position arithmetically operated in a processing in FIG. 10 described later. When it is determined that the instantaneous rotational speed [Rev*-*] is the idle time assist start speed [RevAvg*-*]-<<DefAstON>> or lower, in Step S11, the assist request flag (Rq_MtAst) indicating that the engine needs to be assisted by the motor is set (ON), in Step S12, a rotation reduction flag (IDlLow) is set, and this processing is finished.

When it is determined in Step S10 that the instantaneous rotational speed [Rev*-*] exceeds the idle time assist start speed [RevAvg*-*]-<<DefAstON>>, in Step S13, the instantaneous rotational speed [Rev*-*] is compared with the stable operating time instantaneous rotational speed [RevAvg*-*]. When it is determined that the instantaneous rotational speed [Rev*-*] is lower than the stable operating time instantaneous rotational speed [RevAvg*-*], this processing is finished without performing any processing thereafter. When it is determined in Step S13 that the instantaneous rotational speed [Rev*-*] is the stable operating time instantaneous rotational speed [RevAvg*-*] or higher, in Step S14, the assist request flag (Rq_MtAst) is cleared (OFF), and then this processing is finished.

When the pulse signal generator 28 generates the reference pulse signal Sp1 at the end of a unit section with the section number 21 (once in one combustion cycle), the processing in FIG. 10 is started. When this processing is started, it is determined in Step S101 whether the idle flag (IDL) is set (ON). When the idle flag (IDL) is not set, this processing is finished without performing any processing thereafter. When it is determined in Step S101 that the idle flag (IDL) is set, the process proceeds to Step S102, and it is determined whether the rotation reduction flag (IDlLow) is set (whether rotation is reduced in this combustion cycle). When it is determined that the rotation reduction flag (IDlLow) is not set, it is determined in Step S103 whether the assist request flag (Rq_MtAst) is set (whether the engine is assisted by the motor). When it is determined that the assist request flag (Rq_MtAst) is not set (the engine is not assisted by the motor), the process proceeds to Step S104, and an arithmetical operation processing for obtaining a stable operating time instantaneous rotational speed is performed. In this arithmetical operation processing, first, an instantaneous rotational speed at each specific crank angle position detected in this combustion cycle, and instantaneous rotational speeds at each specific crank angle position detected in the past several combustion cycles are stored in a memory that stores an instantaneous rotational speed at the same specific crank angle position of the last combustion cycle.

Specifically, an instantaneous rotational speed [Rev0-1] at each specific crank angle position detected in this combustion cycle is stored in an address [Rev0-1_B1] that stores an instantaneous rotational speed at the same specific crank angle position in the last combustion cycle, and an instantaneous rotational speed [Rev1-2] at each specific crank angle position detected in the last combustion cycle is stored in an address [Rev1-2_B1] that stores an instantaneous rotational speed at the same specific crank angle position detected in the last combustion cycle but one. An instantaneous rotational speed [Rev2-3] at each specific crank angle position detected in the last combustion cycle but one is stored in an address [Rev2-3_B2] that stores an instantaneous rotational speed at the same specific crank angle position detected in the last combustion cycle but two. Thereafter, similarly, an instantaneous rotational speed at the same specific crank angle position detected in each of the past several combustion cycles is stored in an address that stores an instantaneous rotational speed at the same specific crank angle position detected in the last combustion cycle.

Then, an average value [RevAvg*-*] of the instantaneous rotational speeds at each specific crank angle position detected in the plurality of past combustion cycles and stored in the addresses [Rev*-*_B1], [Rev*-*_B2], [Rev*-*_B3], . . . is arithmetically operated, in Step S105, the rotation reduction flag (IdlLow) is cleared, and this processing is finished. When it is determined in Step S102 that the rotation reduction flag (IDlLow) is set, and it is determined in Step S103 that the assist request flag (Rq_MtAst) is set, the process moves to Step S105, the rotation reduction flag (IdlLow) is cleared, and this processing is finished.

According to the above described algorithm, the instantaneous rotational speed detection means is comprised by Steps S1 and S2 in the processing in FIG. 8, and the operation state determination means 50 is comprised by Steps S3, S4 and S9. The normal time assist necessity determination means 55 is comprised by Steps S5, S6, S7 and S8 in the processing in FIG. 8, and the stable operating time instantaneous rotational speed arithmetical operation means 57 is comprised by the processing in FIG. 10. Further, the determination speed arithmetical operation means 58 is comprised by an unshown process of arithmetically operating the idle time assist start speed [RevAvg*-*]-<<DefAstON>> used in Step S10 in the processing in FIG. 8, and the comparison determination means 59 is comprised by Steps S10 to S14 in FIG. 9.

The crank angle position detection means 51 is comprised by the microprocessor performing a process of assigning a section number to a unit section between crank angle positions where the output signals of the Hall sensors change their levels with reference to the output pulses of the pulse signal generator as shown in FIG. 4, a process of identifying a section number of a unit section following a crank angle position where the output signals of the Hall sensors change their levels for every change in the levels, and a process of detecting each instantaneous angle detection section from successively identified section numbers.

In the above described embodiment, the angle $\alpha$ of the instantaneous rotational speed detection section that is a space between specific crank angle positions is 30°, but the angle of the instantaneous rotational speed detection section is not limited to 30°. For example, in the above described embodiment, the angle $\alpha$ of the instantaneous rotational speed detection section may be 10° when the processing by the microprocessor has leeway.

In the above described example, the number of phases of the armature coil of the motor-generator is three, but a motor-generator including an n-phase (n is an integer equal to or larger than three) armature coil may be used.

In the above described embodiment, in the assist control during idling, the average value of the instantaneous rotational speed detected at each specific crank angle position by the instantaneous rotational speed detection means in the plurality of past combustion cycles is arithmetically operated as the stable operating time instantaneous rotational speed at each specific crank angle position, and the certain value $\Delta N$ is subtracted from the stable operating time instantaneous rotational speed to arithmetically operate the idle time assist start speed. However, it may be allowed that a proper value of the idle time assist start speed at each specific crank angle position is previously experimentally obtained for each idle setting speed, the idle time assist start speed at each specific crank angle position is stored, assisting is started when the instantaneous rotational speed detected at each specific crank angle position becomes the stored idle time assist start speed or lower at each specific crank angle position, and assisting is finished when the instantaneous rotational speed detected at each specific crank angle position exceeds the idle time assist start speed at each specific crank angle position by a certain value or more.

In the embodiment, the present invention is applied to the two cylinder engine, but the present invention may be of course applied to a single cylinder engine or a multi-cylinder engine having three or more cylinders.

In the above described example, the crank angle information of the engine is detected by using the Hall sensors provided in the motor-generator, but an encoder that generates a pulse every time the crankshaft rotates a certain angle (for example, 10° or 30°) may be separately mounted to the engine to obtain crank angle information of the engine from output pulses of the encoder.

As described above, according to the present invention, the rotor of the motor-generator is directly connected to the crankshaft of the engine, and the motor-generator is driven as the motor to start and assist the engine. Thus, gears do not need to mesh with each other or be disengaged from each other at the start and the end of assisting, thereby preventing the life of the starting device for the marine engine from being shortened.

In the present invention, the crank angle position detection means is provided for detecting each specific crank angle position that appears every time the crankshaft of the engine rotates in the instantaneous speed detection section set to be sufficiently narrower than the crank angle section corresponding to each stroke of the combustion cycle of the engine, and the rotational speed detected from the time period between when the last crank angle position is detected and when this crank angle position is detected as the instantaneous rotational speed of the engine, every time the crank angle position detection means detects each specific crank angle position. It is determined whether the engine needs to be assisted from the degree of reduction in the instantaneous rotational speed, and the motor-generator is driven so as to apply the drive force from the motor-generator to the engine when it is determined that the engine needs to be assisted. This allows immediate detection that the engine enters a state where the engine needs to be assisted, and allows the engine to be assisted, thereby reliably preventing the engine from stalling when the shift lever is switched from the advance position to the retraction position or when idling is performed at a low idle setting speed.

In the present invention, the assist necessity determination means is comprised of the normal time assist necessity determination means and the idle time assist necessity determination means, and during idling, with reference to the stable operating time instantaneous rotational speed during idling at each specific crank angle position, it is determined that the engine needs to be assisted when the instantaneous rotational speed detected at each specific crank angle position is the idle time assist start speed or lower set to be lower than the stable operating time instantaneous rotational speed during idling at each specific crank angle position. This allows accurate determination whether the engine needs to be assisted, allows the engine to be assisted immediately when needed, and allows stable idling at a low speed without stalling the engine even when output torque in a low speed rotation area of the engine is low.

In the present invention, the average value of the instantaneous rotational speeds detected at each specific crank angle position by the instantaneous rotational speed detection means in the plurality of past combustion cycles is the stable operating time instantaneous rotational speed at each specific crank angle position during idling of the engine. This allows determination whether the engine needs to be assisted with reference to the actual stable operating time instantaneous rotational speed of the engine, thus allows accurate assist control of the engine without being influenced by variations in characteristics of the engine, and prevents the engine from being stopped during idling.

Although the preferred embodiments of the invention have been described and illustrated with reference to the accompanying drawings, it will be understood by those skilled in the art that there are by way of examples, and that various changes and modifications may be made without departing from the spirit and scope of the invention, which is defined only to the appended claims.

What is claimed is:

1. A control device for a marine engine for controlling the marine engine having a crankshaft to which a rotor of a motor-generator is directly connected, comprising:

crank angle position detection means for detecting each specific crank angle position that appears every time the crankshaft of said engine rotates in an instantaneous speed detection section set to be sufficiently narrower than a crank angle section corresponding to each stroke of a combustion cycle of said engine;

instantaneous rotational speed detection means for detecting, as an instantaneous rotational speed of said engine, a rotational speed of said engine detected from a time period between when the last specific crank angle position is detected and when this specific crank angle position is detected, every time said crank angle position detection means detects each specific crank angle position, and storing data including information on the detected instantaneous rotational speed;

assist necessity determination means for determining whether a drive force needs to be externally applied to the crankshaft of said engine to assist said engine, from the degree of reduction in the instantaneous rotational speed detected by said instantaneous rotational speed detection means; and motor-generator drive means for driving said motor-generator so as to apply the drive force from said motor-generator to the engine when said assist necessity determination means determines that said engine needs to be assisted.

2. The control device for a marine engine according to claim 1, further comprising operation state determination means for determining whether said engine is in an idling state or a normal operation state, wherein said assist necessity determination means includes normal time assist necessity determination means for determining whether the engine needs to be assisted when said operation state determination means determines that said engine is in the normal operation state, and idle time assist necessity determination means for determining whether the engine needs to be assisted when said operation state determination means determines that said engine is in the idling state, said normal time assist necessity determination means is comprised so as to determine that said engine needs to be assisted when the instantaneous rotational speed detected by said instantaneous rotational speed detection means becomes a normal time assist start speed or lower set to a certain value irrespective of the crank angle position, and maintain the state of determination that the engine needs to be assisted until the instantaneous rotational speed detected by said instantaneous rotational speed detection means becomes an assist end speed or higher set to be higher than said normal time assist start speed once it is determined that the engine needs to be assisted, and said idle time assist necessity determination means is comprised so as to determine that said engine needs to be assisted when the instantaneous rotational speed detected at each specific crank angle position by said instantaneous rotational speed detection means is an idle time assist start speed or lower set to be lower than a stable operating time instantaneous rotational speed during said idling at each specific crank angle position, and maintain the state of determination that the engine needs to be assisted until it is detected that the instantaneous rotational speed detected at each specific crank angle position becomes the stable operating time instantaneous rotational speed during said idling at said specific crank angle position once it is determined that the engine needs to be assisted.

3. The control device for a marine engine according to claim 2, wherein said idle time assist necessity determination means includes stable operating time instantaneous rotational speed arithmetical operation means for arithmetically operating, as said stable operating time instantaneous rotational speed at each specific crank angle position, an average value of instantaneous rotational speeds detected at each specific crank angle position by said instantaneous rotational speed detection means in a plurality of past combustion cycles during idling of said engine.

4. The control device for a marine engine according to claim 3, wherein said motor-generator is a rotating electric machine including a magnetic field provided in a rotor, an n-phase (n is an integer equal to or larger than three) armature coil provided in a stator, and n Hall sensors that detect a polarity of a magnetic pole of the rotor on the side of the stator to generate a signal for obtaining information on a rotational angle position of the rotor with respect to the n-phase armature coil of the stator, and comprised so as to operate as a motor when a driving current that is commutated in a predetermined phase order according to output signals of said n Hall sensors is passed through said armature coil, and said crank angle position detection means is comprised so as to detect a crank angle position where the signals outputted by said n Hall sensors change their levels as said specific crank angle position.

5. The control device for a marine engine according to claim 2, wherein said motor-generator is a rotating electric machine including a magnetic field provided in a rotor, an n-phase (n is an integer equal to or larger than three) armature coil provided in a stator, and n Hall sensors that detect a polarity of a magnetic pole of the rotor on the side of the stator to generate a signal for obtaining information on a rotational angle position of the rotor with respect to the n-phase armature coil of the stator, and comprised so as to operate as a motor when a driving current that is commutated in a predetermined phase order according to output signals of said n Hall sensors is passed through said armature coil, and said crank angle position detection means is comprised so as to detect a crank angle position where the signals outputted by said n Hall sensors change their levels as said specific crank angle position.

6. The control device for a marine engine according to claim 1, wherein said motor-generator is a rotating electric machine including a magnetic field provided in a rotor, an n-phase (n is an integer equal to or larger than three) armature coil provided in a stator, and n Hall sensors that detect a polarity of a magnetic pole of the rotor on the side of the stator to generate a signal for obtaining information on a rotational angle position of the rotor with respect to the n-phase armature coil of the stator, and comprised so as to operate as a motor when a driving current that is commutated in a predetermined phase order according to output signals of said n Hall sensors is passed through said armature coil, and said crank angle position detection means is comprised so as to detect a crank angle position where the signals outputted by said n Hall sensors change their levels as said specific crank angle position.

* * * * *